United States Patent [19]

Kraske et al.

[11] 4,397,603

[45] Aug. 9, 1983

[54] BACKHOE SLIDE FRAME AND SWING MECHANISM

[75] Inventors: Leroy E. Kraske, Dubuque; Gregory K. Werner, Durango; Lynn I. Beauchamp, Dubuque, all of Iowa

[73] Assignee: Deere & Company, Moline, Ill.

[21] Appl. No.: 349,797

[22] Filed: Feb. 18, 1982

[51] Int. Cl.[3] ..... E02F 3/75

[52] U.S. Cl. ..... 414/695.5; 414/686; 414/687

[58] Field of Search ..... 414/694, 695, 695.5, 414/686, 687

[56] References Cited

U.S. PATENT DOCUMENTS

| | | | |
|---|---|---|---|
| 3,304,100 | 2/1967 | Long | 414/695 X |
| 3,495,727 | 2/1970 | Long | 414/695.5 |
| 3,728,768 | 4/1973 | Mori | 414/695 X |
| 4,046,346 | 9/1977 | Iijima et al. | 414/695 X |

*Primary Examiner*—Robert J. Spar

*Assistant Examiner*—Terrance L. Siemens

[57] ABSTRACT

A side-shift backhoe includes a slide frame having an upper end forming a downwardly opening receptacle having a cylindrically curved inner surface engaged with a complementary shaped surface of an upper transverse guide rail of a support frame. The slide frame also includes a transverse member which is releasably secured to a lower end of the frame and includes an upwardly- and rearwardly-facing abutment surface disposed for engagement with a downwardly and forwardly-facing abutment surface of a lower transverse guide rail of the support frame. A pair of linear hydraulic swing actuators are located between upper and lower transversely-extending mounting bars, and the cylinders of the actuators are each swivelly mounted to the bars with the bars and actuators forming a swing actuator unit. The swing actuator unit is releasably secured to the slide frame such that the actuators project through a central, fore-and-aft extending opening provided in the slide frame.

1 Claim, 3 Drawing Figures

BACKHOE SLIDE FRAME AND SWING MECHANISM

BACKGROUND OF THE INVENTION

The present invention relates to side-shift backhoes and more particularly relates to slide frames and swing mechanism arrangements for such backhoes.

Side-shift backhoes conventionally comprise a transverse support frame adapted for being supported at the rear end of a tractor, or the like, and defining one or more slide rails or surfaces. A slide frame is mounted for movement along the slide frame, and means are provided for clamping or securing the slide frame in selected positions by hydraulic actuators or fastener hardware. A swing frame is horizontally pivotally mounted on the slide frame. Connected between the slide and swing frames for selectively pivoting the swing frame is either a rotary hydraulic actuator or one or two linear hydraulic actuators acting directly, through linkage or through gearing.

Swing mechanisms comprising a pair of linear hydraulic actuators connected directly between the slide and swing frames are the least expensive of the mechanisms used to pivot the swing frames, and it is with this type of swing mechanism to which the present invention pertains. One example of such a swing mechanism is disclosed in U.S. Pat. No. 4,039,095 issued to Long on Aug. 2, 1977.

SUMMARY OF THE INVENTION

According to the present invention there is provided an improved combination of a slide frame and swing mechanism and more specifically there is provided such a combination utilizing linear hydraulic actuators.

An object of the invention is to provide a slide frame and swing mechanism combination which on the one hand is compact and on the other hand may be easily assembled and disassembled without encountering interferring or obstructing structure.

A more specific object is to provide a swing actuator unit including a pair of linear hydraulic actuators positioned in side-by-side relationship to each other between upper and lower mounting bars, with the actuators being swivelly mounted to the bars and with the bars being releasably secured to the slide frame such that the actuators project through a central opening provided in the slide frame.

Yet another object is to provide a slide frame having an upper receptacle-forming portion adapted for engaging a complementary shaped transverse upper rail of a support and thereby suspending the slide frame from the support frame and to provide a releasably mounted abutment member at the bottom of the slide frame which when removed will permit the slide frame to be easily suspended from the support frame.

These and other objects will become apparent from a reading of the following description together with the appended drawings.

DESCRIPTION OF THE PREFERRED EMBODIMENT

Figure 1:
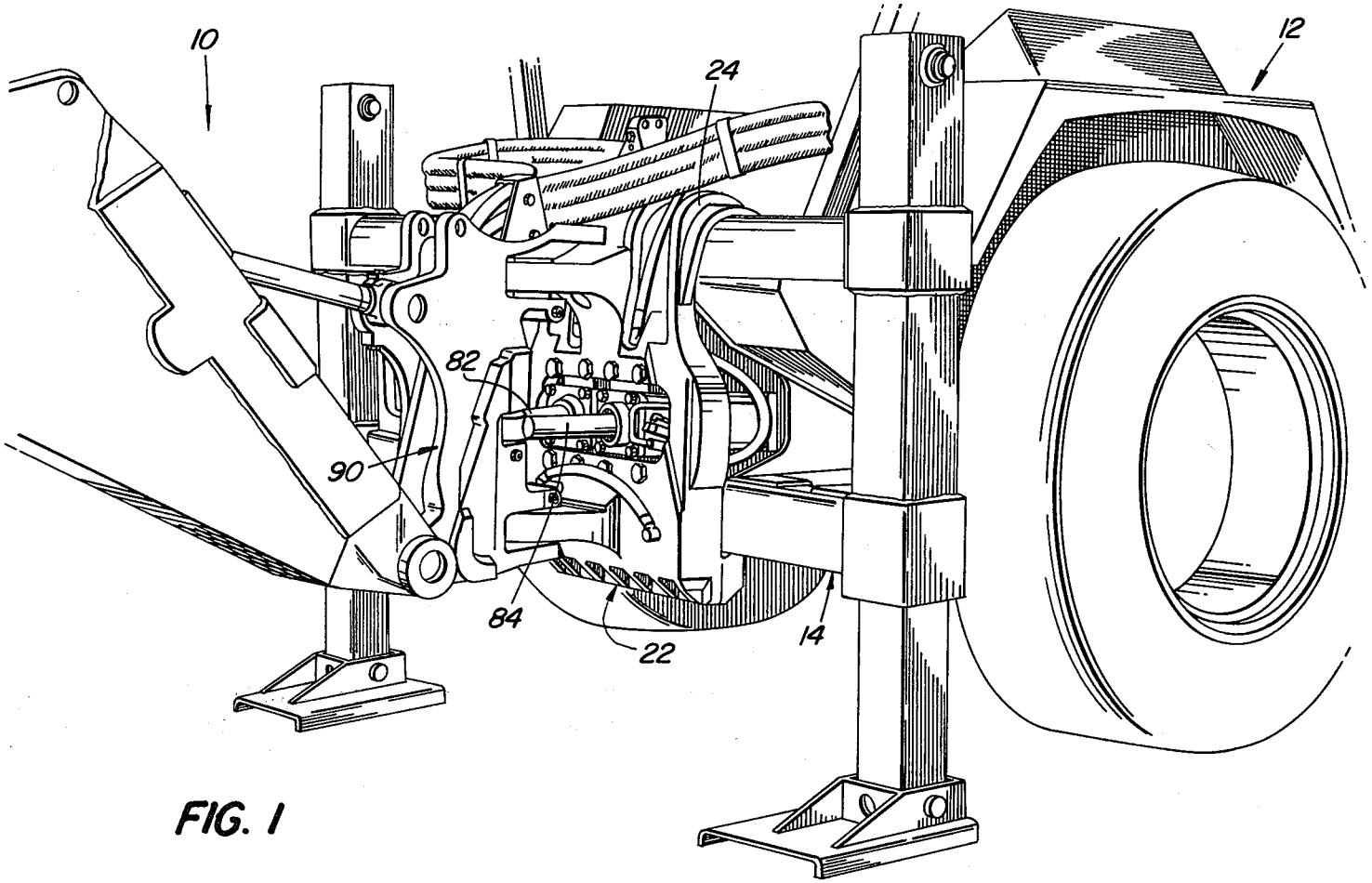
FIG. 1 is a right rear perspective view showing a slide frame backhoe embodying the present invention.
Figure 2:
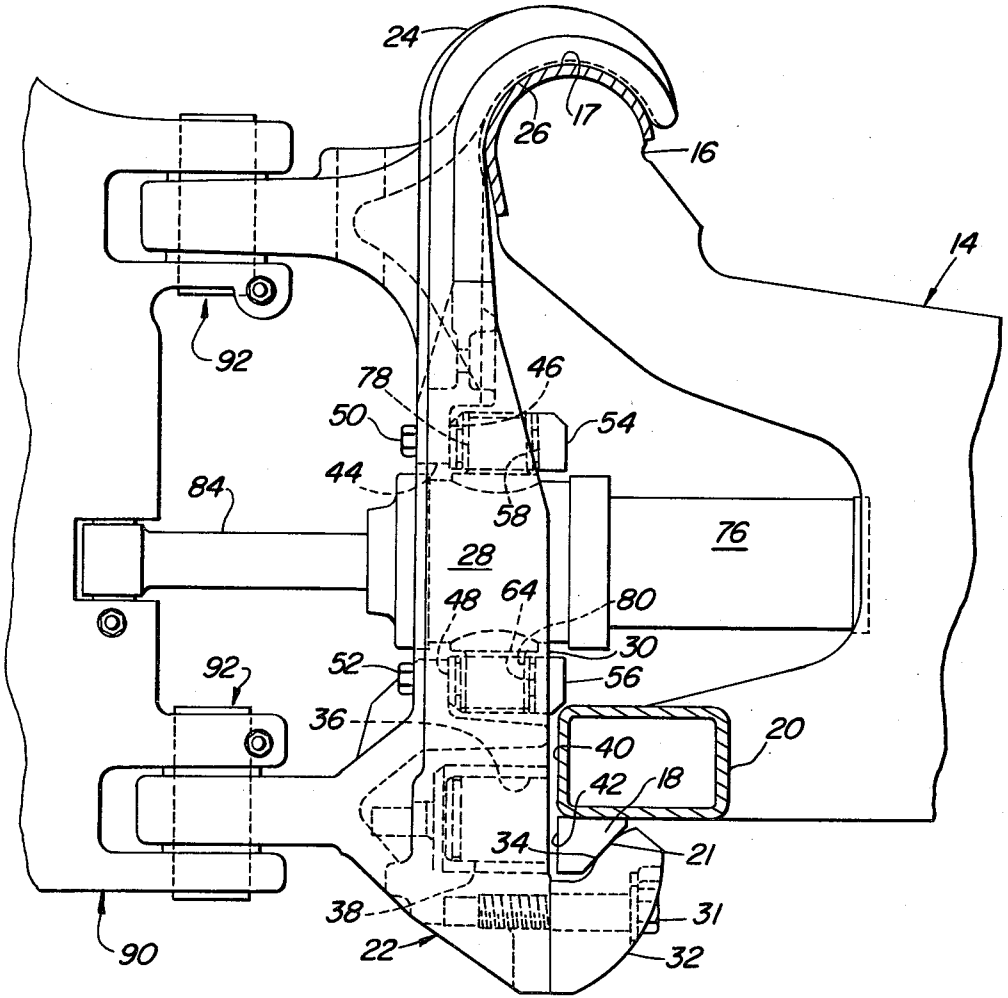
FIG. 2 is a right side elevational view showing the support and slide frames.

Referring now to FIGS. 1 and 2, therein is shown a side-shift backhoe 10 mounted on the rear of a tractor 12. The backhoe 10 includes a transverse support frame 14 including an upper rail 16 having a cylindrically curved upper surface 17 and a lower rail 18 formed by a bar welded to the lower rear surface portion of a transverse box beam 20. The rail 18 includes a downwardly- and forwardly-facing abutment surface 21 having a purpose to be presently described.

A slide frame 22 includes an upper end 24 which is curved forwardly so as to define a downwardly-opening receptacle 26 being engaged with the upper rail 16 and having a shape complementary to the surface 17 thereof. The slide frame 22 further includes a central body portion 28 having a foremost, forwardly-facing, substantially planar transverse surface 30. Releasably secured to the lower portion of the surface 30, as by bolts 31, is a transverse member 32 which extends upwardly and forwardly to a location forwardly of the lower rail 18, the member 32 having an arcuate upwardly- and rearwardly-facing abutment surface 34 positioned for engagement with the abutment surface 21 upon the slide frame 22 being rotated clockwise about its connection with the upper rail 16, in a manner to be presently described. The releasability of the member 32 aids in the installation of the slide frame 22 on the support frame 14 since with the member 32 removed, the frame 22 needs only to be lifted to the extent necessary to engage the receptacle 26 with the rail 16 so as to suspend the frame 22 from the frame 14. The member 32 can then be installed.

Reciprocably mounted in a pair of fore-and-aft extending, transversely spaced cylinder bores 36 provided in the central body portion 28 of the frame 22 are a pair of hydraulically operated pistons 38, which are located so as to bear partly on a vertical, rearwardly-facing surface 40 of the beam 20 and partly on a vertical rearwardly-facing surface 42 of the rail 18 when fluid pressure is introduced into the bores 36 rearwardly of the pistons 38.

Pressure engagement of the pistons 38 with the surfaces 40 and 42 results in the frame 22 rocking clockwise about its connection with the upper rail 16 and consequently in the abutment surface 34 becoming engaged with the abutment surface 21. Because of the inclination of the surface 21, the force exerted by the pistons will have a vertical component which acts to clampingly engage the receptacle 26 with the upper rail 16 so as to prevent the frame 22 from shifting sideways.

Figure 3:
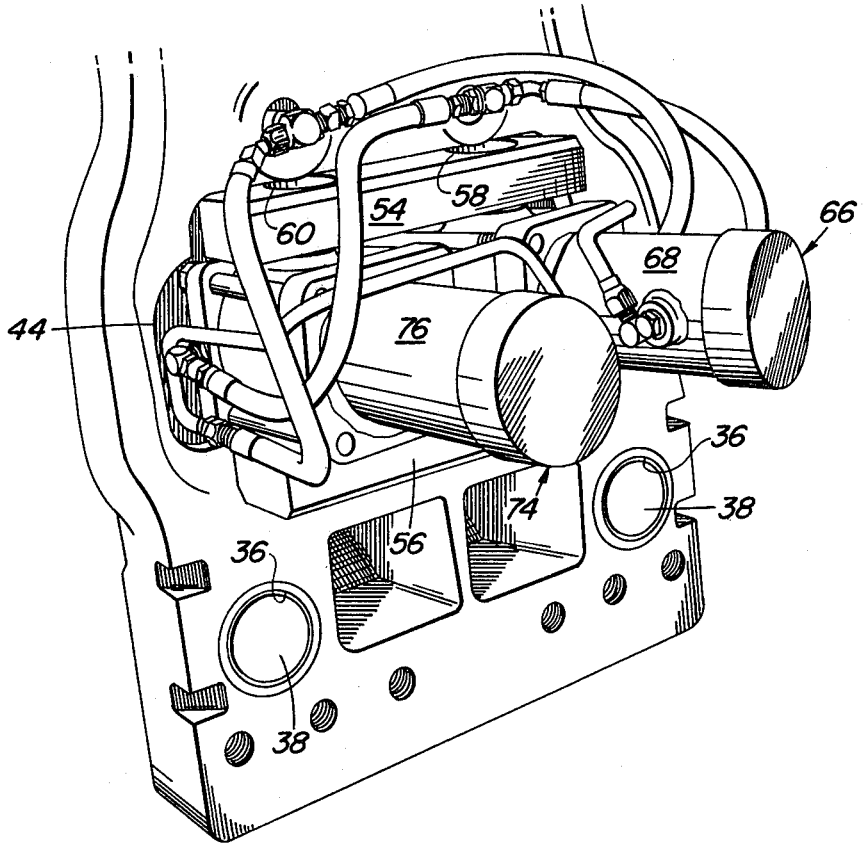
FIG. 3 is a right rear perspective view of the slide frame and swing actuators.

The central body portion 28 of the slide frame is provided with a relatively large, fore-and-aft, generally rectangular opening 44. Bordering upper and lower boundaries of the opening 44, at the forward side of the frame 22, are upper and lower forwardly-facing mounting surfaces 46 and 48, respectively, which are recessed rearwardly from the substantially planar surface 30. Releasably secured against the surfaces 46 and 48, as by upper and lower sets of bolts 50 and 52, respectively, are upper and lower, actuator-mounting bars 54 and 56. The bars 54 and 56 are generally rectangular in vertical cross section. The bar 54, as viewed in FIG. 3, is provided with right- annd left-hand vertical bores 58 and 60, respectively, which are disposed in axial alignment with a similar bore 62 (not shown) in the right-hand end of the bar 56 and a bore 64 (FIG. 2) provided in the left-hand end of the bar 56. A right-hand linear hydraulic swing actuator 66 includes a cylinder 68 having upper and lower stub shafts (not shown) projecting oppositely from adjacent the rod end thereof and respectively pivotally received in the bore 58 of the bar 54 and the aligned bore of the bar 56. Similarly, a left-hand linear hydraulic swing actuator 74 includes a cylinder 76 having upper and lower stub shafts 78 and 80 projecting oppositely from adjacent the rod end thereof and respectively pivotally received in the bores 60 and 64. Projecting from the rear ends of the cylinders 68 and 76 are piston rods 82 and 84, respectively, which are directly pivotally connected to transversely-spaced lugs forming portions of a swing frame 90 which is mounted on the slide frame 22 by means of a vertical pivot assembly 92. The piston rods 82 and 84 are connected to the swing frame 90 in such relationship to the pivot assembly 92 that the frame 90 is pivoted leftwardly, as viewed in FIG. 1, by retraction of the rod 82 and extension of the rod 84 and is pivoted rightwardly by retraction of the rod 84 and extension of the rod 82.

Thus it will be appreciated that by making the mounting portion for the swing actuators 66 and 74 in the form of the releasable bars 54 and 56, the actuators may be easily mounted to the bars without the presence of other structure which might interfere with their mounting, and then the assembled swing unit comprising the actuators and bars may be easily mounted to the remainder of the swing frame structure since the bolts are installed from the rear side of the swing frame 22 which is completely devoid of possibly interfering structure.

We claim:

1. In a side-shift backhoe slide frame including upper and lower rail engaging surfaces adapted for engaging and sliding along complementary surfaces of a support frame, the improvement comprising: said slide frame defining a generally rectangular fore-and-aft opening located below the upper rail-engaging surface; upper and lower vertical surfaces respectively forming recessed portions of a front side of the slide frame and bordering said opening respectively at the top and bottom thereof; first and second side-by-side disposed swing cylinders; each of said cylinders being provided with upper and lower aligned vertical stub shafts; an upper-mounting block having a pair of openings respectively rotatably receiving the upper stub shafts of the swing cylinders; a lower-mounting block having a pair of openings, respectively, rotatably receiving the lower stub shafts of the swing cylinders; and means respectively, releasably securing the upper and lower mounting blocks in place against the upper and lower vertical surfaces.

* * * * *